US010959550B2

(12) United States Patent
Broussard

(10) Patent No.: US 10,959,550 B2
(45) Date of Patent: Mar. 30, 2021

(54) ELECTRONICALLY COOLED CONTAINER ASSEMBLY

(71) Applicant: Morris Broussard, Richmond, TX (US)

(72) Inventor: Morris Broussard, Richmond, TX (US)

( * ) Notice: Subject to any disclaimer, the term of this patent is extended or adjusted under 35 U.S.C. 154(b) by 194 days.

(21) Appl. No.: 15/982,826

(22) Filed: May 17, 2018

(65) Prior Publication Data

US 2019/0350390 A1 Nov. 21, 2019

(51) Int. Cl.

| | |
|---|---|
| ***A47G 19/12*** | (2006.01) |
| ***F25D 31/00*** | (2006.01) |
| ***F25B 21/02*** | (2006.01) |

(52) U.S. Cl.

CPC ..... *A47G 19/127* (2013.01); *F25B 21/02* (2013.01); *F25D 31/006* (2013.01); *A47G 2200/186* (2013.01); *F25D 2331/81* (2013.01); *F25D 2400/40* (2013.01)

(58) Field of Classification Search

CPC ..... F25D 31/002–008; F25D 2331/81; F25D 2400/40; F25D 2303/0842; F25D 31/006; F25B 2321/023; F25B 21/02; A47G 19/127; A47G 2200/186

See application file for complete search history.

(56) References Cited

U.S. PATENT DOCUMENTS

| | | | | |
|---|---|---|---|---|
| 4,880,535 | A * | 11/1989 | Burrows | B01D 61/08 210/181 |
| 5,718,124 | A | 2/1998 | Senecal | |
| D400,053 | S | 10/1998 | Coffee | |
| 6,013,901 | A * | 1/2000 | Lavoie | A47G 19/2227 219/435 |
| 6,591,615 | B1 * | 7/2003 | Luo | F25B 21/04 62/3.3 |
| 9,365,146 | B1 | 6/2016 | Allen | |
| 9,493,102 | B2 | 11/2016 | Tang | |
| 2008/0223882 | A1 * | 9/2008 | Maxwell | A47G 19/12 222/466 |
| 2009/0038317 | A1 | 2/2009 | Otey | |
| 2010/0126695 | A1 | 5/2010 | Gara | |

* cited by examiner

*Primary Examiner* — Frantz F Jules
*Assistant Examiner* — Webeshet Mengesha

(57) ABSTRACT

A electronically cooled container assembly for cooling a beverage includes a base is positionable on a support surface. A thermoelectric cooling coil is positioned within the base and the thermoelectric coiling coil is in thermal communication with the base. The thermoelectric cooling coil absorbs heat from the base when the thermoelectric cooling coil is turned on thereby cooling the base. A pitcher for containing a beverage is provided and the pitcher is comprised of a translucent material. The pitcher is positionable on the base such that the pitcher is in thermal communication with the base. Moreover, the thermoelectric cooling coil cools the pitcher when the thermoelectric cooling coil is turned on for cooling the beverage.

5 Claims, 3 Drawing Sheets

ELECTRONICALLY COOLED CONTAINER ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cooled container devices and more particularly pertains to a new cooled container device for cooling a beverage.

BRIEF SUMMARY OF THE INVENTION

An embodiment of the disclosure meets the needs presented above by generally comprising a base is positionable on a support surface. A thermoelectric cooling coil is positioned within the base and the thermoelectric coiling coil is in thermal communication with the base. The thermoelectric cooling coil absorbs heat from the base when the thermoelectric cooling coil is turned on thereby cooling the base. A pitcher for containing a beverage is provided and the pitcher is comprised of a translucent material. The pitcher is positionable on the base such that the pitcher is in thermal communication with the base. Moreover, the thermoelectric cooling coil cools the pitcher when the thermoelectric cooling coil is turned on for cooling the beverage.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
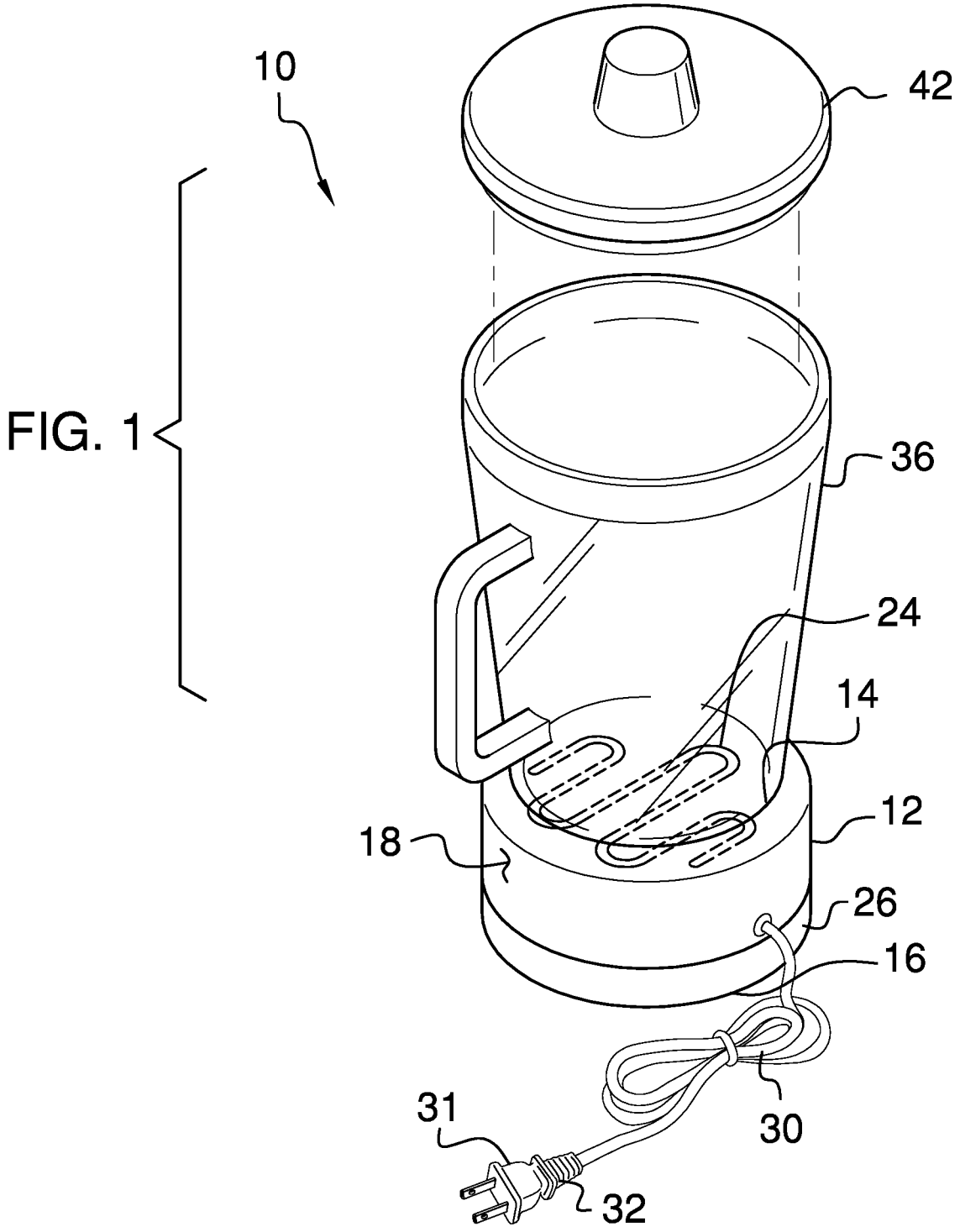
FIG. 1 is a top perspective view of an electronically cooled container assembly according to an embodiment of the disclosure.
Figure 2:
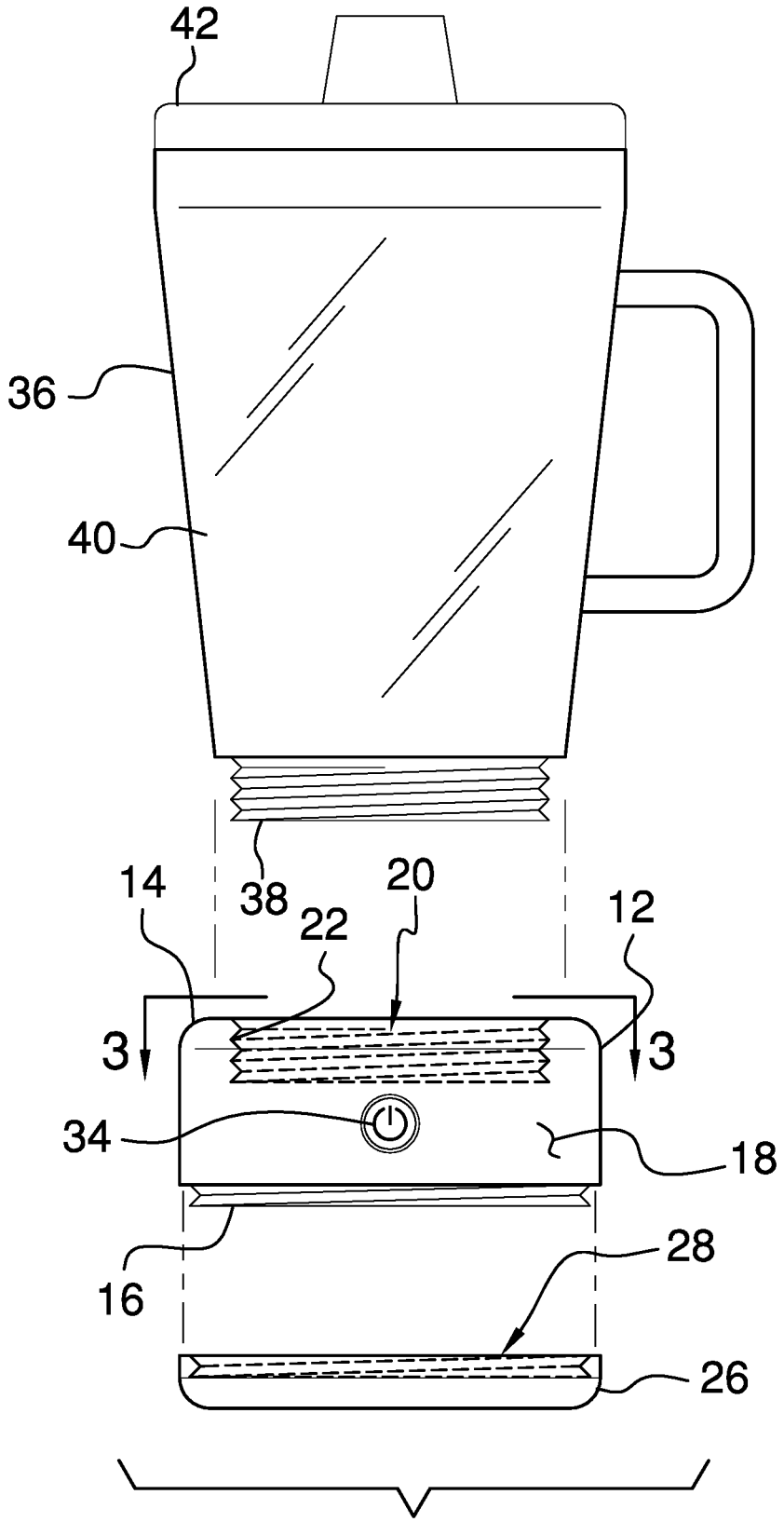
FIG. 2 is a front phantom view of an embodiment of the disclosure.
Figure 3:
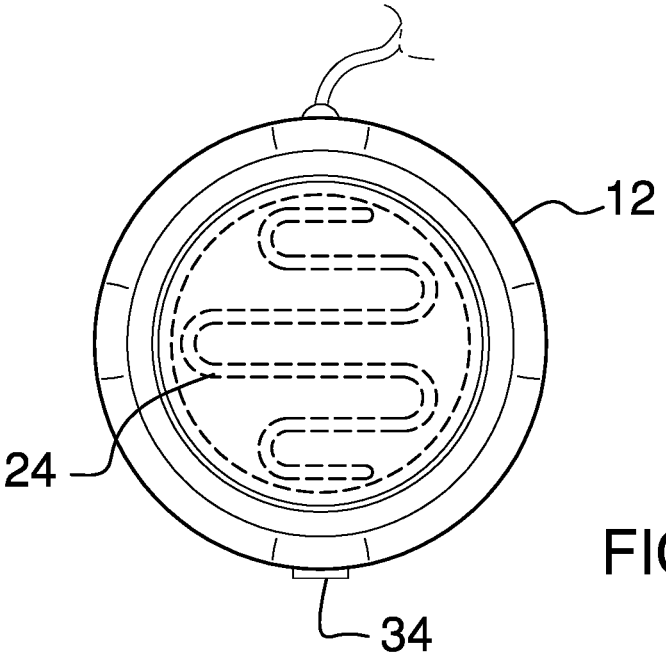
FIG. 3 is a cross sectional view taken along line 3-3 of FIG. 2 of an embodiment of the disclosure.
Figure 4:
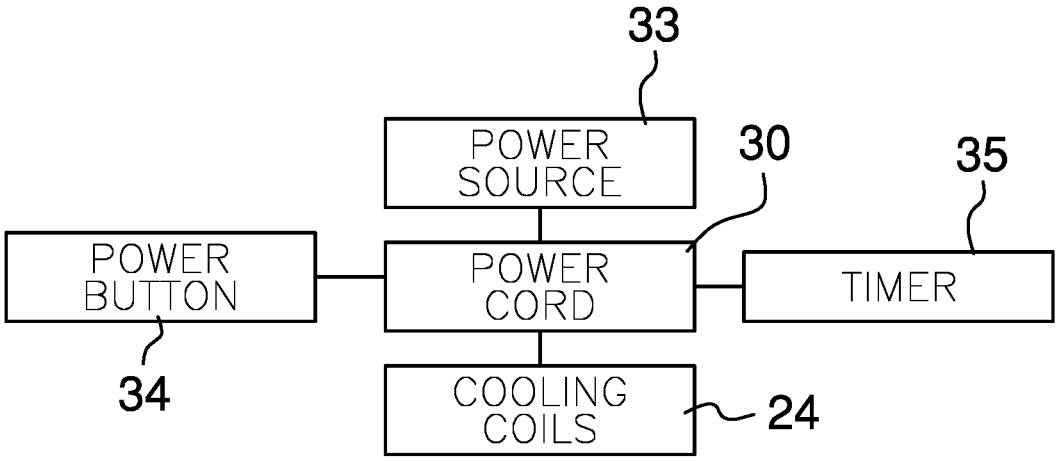
FIG. 4 is a schematic view of an embodiment of the disclosure.

With reference now to the drawings, and in particular to FIGS. 1 through 4 thereof, a new cooled container device embodying the principles and concepts of an embodiment of the disclosure and generally designated by the reference numeral 10 will be described.

As best illustrated in FIGS. 1 through 4, the electronically cooled container assembly 10 generally comprises a base 12 that is positionable on a support surface. The base 12 has a top surface 14, a bottom surface 16 and an outer surface 18 extending therebetween. The top surface 14 has a well 20 extending toward the bottom surface 16, the well 20 has a bounding surface 22 and the bounding surface 22 is threaded. Additionally, the outer surface 18 is threaded adjacent to the bottom surface 16. The outer surface 18 may be continuously arcuate such that the base 12 has a disk shape.

A thermoelectric cooling coil 24 is positioned within the base 12 and the thermoelectric coiling coil is in thermal communication with the base 12. The thermoelectric cooling coil 24 absorbs heat from the base 12 when the thermoelectric cooling coil 24 is turned on thereby cooling the base 12. The thermoelectric cooling coil 24 may be a Peltier device or other device that operates by the Peltier effect. A pan 26 is provided that contains a thermally conductive fluid 28, such as water or the like. The pan 26 threadably engages the outer surface 18 of the base 12 such that the pan 26 is removably coupled to the bottom surface 16. In this way the thermally conductive fluid 28 is placed in thermal communication with the base 12 thereby enhancing heat transfer between the base 12 and the thermoelectric cooling coil 24.

A power cord 30 is coupled to and extends away from the base 12 and the power cord 30 is electrically coupled to the thermoelectric cooling coil 24. The power cord 30 has a distal end 32 with respect to the base 12 and a plug 31 is electrically coupled the distal end 32 for plugging into a power source 33, such as a female electrical outlet or the like. A power button 34 is movably coupled to the base 12 and the power button 34 is electrically coupled to the thermoelectric cooling coil 24. The power button 34 turns the thermoelectric cooling coil 24 on and off when the power button 34 is manipulated. An electronic timer 35 is positioned within the base 12 and the electronic timer 35 is electrically coupled to the thermoelectric cooling coil 24. The electronic timer 35 turns off the thermoelectric cooling cool 24 after a trigger duration of time has elapsed.

A pitcher 36 for containing a beverage is provided and the pitcher 36 is comprised of a translucent material that conforms to beverage container requirements imposed by various state Departments of Corrections. Thus, the pitcher 36 may be used in a correctional environment, such as county jails, state prisons and other correctional institutions. The pitcher 36 is positionable on the base 12 such that the pitcher 36 is in thermal communication with the base 12. The thermoelectric cooling coil 24 cools the pitcher 36 when the thermoelectric cooling coil 24 is turned on thereby cooling the beverage. The pitcher 36 has a bottom wall 38 and an outer wall 40 extending upwardly therefrom. The outer wall 40 of the pitcher 36 is threaded adjacent to the bottom wall 38 and the outer wall 40 of the pitcher 36 threadably engages the bounding surface 22 of the well 20 thereby retaining the pitcher 36 on the base 12. A lid 42 is provided to close the pitcher 36.

In use, the thermally conductive fluid 28 is poured into the pan 26 and the pan 26 is attached to the bottom of the base 12. The power cord 30 is plugged in and the power button 34 is manipulated to turn on the thermoelectric cooling coil 24. The thermoelectric cooling coil 24 cools the base 12 while the thermoelectric cooling coil 24 is turned on. The pitcher 36 is threaded onto the base 12 and the beverage is poured into the pitcher 36. Thus, the base 12 cools the pitcher 36 thereby cooling the beverage. In this way the beverage can be cooled without ice so long as the thermoelectric cooling coil 24 is plugged in. Moreover, the translucent pitcher 36 meets container requirements for correctional institutions.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An electronically cooled container assembly being configured to contain and chill a fluid, said assembly comprising:

a base being positionable on a support surface, said base having a top surface, a bottom surface and an outer surface extending therebetween, said top surface having a well extending toward said bottom surface, said well having a bounding surface, said bounding surface being threaded, said outer surface being threaded adjacent to said bottom surface;

a thermoelectric cooling coil being positioned within said base, said thermoelectric cooling coil being in thermal communication with said base, said thermoelectric cooling coil absorbing heat from said base when said thermoelectric cooling coil is turned on thereby cooling said base;

a pitcher for containing a beverage, said pitcher being comprised of a translucent material, said pitcher being positionable on said base such that said pitcher is in thermal communication with said base, said thermoelectric cooling coil cooling said pitcher when said thermoelectric cooling coil is turned on for cooling the beverage; and a pan for containing a thermally conductive fluid, said pan threadably engaging said outer surface of said base having said pan being removably coupled to said bottom surface such that said thermally conductive fluid is in thermal communication with said base thereby enhancing heat transfer between said base and said thermoelectric coil, said pan having an exterior surface being sized and shaped the same as said outer surface of said base wherein said exterior surface is positioned against and flush with said outer surface when said pan is engaged to said base.

2. The assembly according to claim 1, further comprising a power cord being coupled to and extending away from said base, said power cord being electrically coupled to said thermoelectric cooling coil, said power cord having a distal end with respect to said base, said distal end having a plug being electrically coupled thereto wherein said plug is configured to be electrically coupled to a power source.

3. The assembly according to claim 2, further comprising a power button being movably coupled to said base, said power button being electrically coupled to said thermoelectric cooling coil, said power button turning said thermoelectric cooling coil on and off when said power button is manipulated.

4. The assembly according to claim 1, wherein said pitcher has a bottom wall and an outer wall extending upwardly therefrom, said outer wall of said pitcher being threaded adjacent to said bottom wall, said outer wall of said pitcher threadably engaging said bounding surface of said well thereby retaining said pitcher on said base.

5. An electronically cooled container assembly being configured to contain and chill a fluid, said assembly comprising:

a base being positionable on a support surface, said base having a top surface, a bottom surface and an outer surface extending therebetween, said top surface having a well extending toward said bottom surface, said well having a bounding surface, said bounding surface being threaded, said outer surface being threaded adjacent to said bottom surface;

a thermoelectric cooling coil being positioned within said base, said thermoelectric cooling coil being in thermal communication with said base, said thermoelectric cooling coil absorbing heat from said base when said thermoelectric cooling coil is turned on thereby cooling said base;

a pan for containing a thermally conductive fluid, said pan threadably engaging said outer surface of said base having said pan being removably coupled to said bottom surface such that said thermally conductive fluid is in thermal communication with said base thereby enhancing heat transfer between said base and said thermoelectric coil, said pan having an exterior surface being sized and shaped the same as said outer surface of said base wherein said exterior surface is positioned against and flush with said outer surface when said pan is engaged to said base;

a power cord being coupled to and extending away from said base, said power cord being electrically coupled to said thermoelectric cooling coil, said power cord having a distal end with respect to said base, said distal end having a plug being electrically coupled thereto wherein said plug is configured to be electrically coupled to a power source;

a power button being movably coupled to said base, said power button being electrically coupled to said thermoelectric cooling coil, said power button turning said thermoelectric cooling coil on and off when said power button is manipulated; and a pitcher for containing a beverage, said pitcher being comprised of a translucent material, said pitcher being positionable on said base such that said pitcher is in thermal communication with said base, said thermoelectric cooling coil cooling said pitcher when said thermoelectric cooling coil is turned on for cooling the beverage, said pitcher having a bottom wall and an outer wall extending upwardly therefrom, said outer wall of said pitcher being threaded adjacent to said bottom wall, said outer wall of said pitcher threadably engaging said bounding surface of said well thereby retaining said pitcher on said base.

* * * * *